US011764511B2

(12) United States Patent
Fischer et al.

(10) Patent No.: US 11,764,511 B2
(45) Date of Patent: Sep. 19, 2023

(54) ASSEMBLY COMPRISING A CONNECTOR AND A HANDLING CLIP

(71) Applicant: Rosenberger Hochfrequenztechnik Gmbh & Co. KG, Fridolfing (DE)

(72) Inventors: Andreas Fischer, Eiselfing (DE); Elisabeth Preintner, Ampfing (DE)

(73) Assignee: ROSENBERGER HOCHFREQUENZTECHNIK GMBH, Fridolfing (DE)

( * ) Notice: Subject to any disclaimer, the term of this patent is extended or adjusted under 35 U.S.C. 154(b) by 0 days.

(21) Appl. No.: 17/359,803

(22) Filed: Jun. 28, 2021

(65) Prior Publication Data

US 2022/0416467 A1 Dec. 29, 2022

(30) Foreign Application Priority Data

Jun. 4, 2020 (EP) ..... 20178237

(51) Int. Cl.
*H01R 13/506* (2006.01)
*H01R 13/631* (2006.01)

(52) U.S. Cl.
CPC ..... *H01R 13/506* (2013.01); *H01R 13/631* (2013.01)

(58) Field of Classification Search
CPC .... H01R 13/506; H01R 13/516; H01R 13/58; H01R 13/582; H01R 13/5804; H01R 13/5812; H01R 13/5845
See application file for complete search history.

(56) References Cited

U.S. PATENT DOCUMENTS 5,702,265 A * 12/1997 Yamaguchi ..... H01R 13/506 439/352
6,478,608 B1 * 11/2002 Grant ..... H01R 13/506 439/456
6,953,362 B2 * 10/2005 Mossner ..... H01R 13/582 439/694
10,205,266 B1 2/2019 Peterson et al.
10,290,970 B1 * 5/2019 Weber, Jr. ..... H01R 13/5829
2002/0065044 A1 5/2002 Cech et al.
2003/0092324 A1 * 5/2003 Walker ..... H01R 13/005 439/752
2006/0172612 A1 * 8/2006 Wasalaski ..... H01R 13/447 439/752

(Continued)

FOREIGN PATENT DOCUMENTS

DE 20 2007 010061 U1 1/2001
DE 10 2006 035724 A1 1/2008

(Continued)

*Primary Examiner* — Oscar C Jimenez
(74) *Attorney, Agent, or Firm* — David P. Dickerson

(57) ABSTRACT

An actuating clip (1) for a connector (10), having a cable receptacle (2) for receiving at least one cable; connecting means in order to connect the actuating clip to the connector in such a manner that the actuating clip adjoins the connector at a cable-side end of the connector; surfaces for actuating the connector (10), which are configured to ensure guiding of the connector (10) when the latter is connected to an actuating clip by the surfaces of the actuating clip (1) being able to be gripped by a human hand and/or by a gripping tool, wherein the surfaces of the actuating clip (1) are specifically designed to be gripped by a hand and/or by a gripping tool.

21 Claims, 2 Drawing Sheets

(56) References Cited

U.S. PATENT DOCUMENTS

| | | | | |
|---|---|---|---|---|
| 2007/0093120 | A1* | 4/2007 | Hardy | H01R 13/506 439/468 |
| 2008/0160824 | A1* | 7/2008 | Liu | H01R 13/567 439/456 |
| 2010/0221939 | A1* | 9/2010 | Fakhri | H01R 13/639 439/153 |
| 2016/0020551 | A1* | 1/2016 | Schnurpfeil | H01R 24/60 439/465 |
| 2017/0331222 | A1 | 11/2017 | Pham et al. | |
| 2018/0323536 | A1* | 11/2018 | Sato | H01R 13/5808 |
| 2020/0044376 | A1* | 2/2020 | Ichikawa | H05K 1/18 |
| 2020/0266570 | A1* | 8/2020 | Dogoldogol | H01R 13/465 |

FOREIGN PATENT DOCUMENTS

| | | | |
|---|---|---|---|
| DE | 10 2009 053364 | B3 | 1/2011 |
| WO | 2016059233 | A1 | 4/2016 |

* cited by examiner

ASSEMBLY COMPRISING A CONNECTOR AND A HANDLING CLIP

FIELD OF THE INVENTION

The invention relates to an actuating clip and to a connector arrangement having a connector and an actuating clip.

TECHNICAL BACKGROUND

Connectors are known. It is also known to mount connectors in tight installation space conditions. During the installation of a connector in a tight installation space, difficulties may occur of there being sufficient space for the mounting tool or for installation with a fitter's hand.

SUMMARY OF THE INVENTION

Inter alia, the present disclosure teaches an actuating clip for a connector, having a cable receptacle for receiving at least one cable; connecting means in order to connect the actuating clip to the connector in such a manner that the actuating clip adjoins the connector at a cable-side end of the connector; surfaces for actuating the connector, which are configured to ensure guiding of the connector when the latter is connected to an actuating clip by the surfaces of the actuating clip being able to be gripped by a human hand and/or by a gripping tool, wherein the surfaces of the actuating clip are specifically designed to be gripped by a hand and/or by a gripping tool.

The present disclosure also teaches a connector assembly, comprising an electrical connector, and a handling clip, wherein the electrical connector comprises an interface portion and a cable-receiving portion, the cable-receiving portion comprises a first cable receptacle, the handling clip comprises a second cable receptacle, and the cable-receiving portion and the handling clip are shaped such that a motion of the handling clip relative to the cable-receiving portion from a separated state toward a joined state incurs a dilation of the second cable receptacle.

Connectors ensure the releasable connection of a cable to a further electrical or electronic component. Accordingly, a connector comprises an interface-side end that is connected to the further component, and a cable-side end at which the connector is connected to the cable.

In this patent application, the term cable includes electrical conductors that are not insulated and electrical conductors that are surrounded by electrical insulation, for example a plastics sheathing. A cable can have one or more electrical conductors.

In this patent application, connecting means are used for fastening the actuating clip to the connector. Accordingly, the connecting means can be embodied as latching means, a bayonet connection, a screw connection and/or the like.

Guiding of the connector means that the connector is guided along a specific direction of movement. For example, the connector during the installation has to be guided on a further component in order to bring the interface-side end of the connector into contact with the further component.

In this patent application, the installation of a connector is understood as meaning that a connector is plugged to a further component, i.e., for example, a mating connector.

Recesses in the interior of the actuating clip are chambers that are recessed from the material of the actuating clip. Accordingly, the recesses in the interior of the actuating clip are generally filled with air.

Spring elasticity ensures elastic deformability under the action of a force, wherein the deformation is reversed as the action of a force decreases.

Expansion means that the circumference of an expanded object is enlarged.

Examples of latching means include latching lugs, latching hooks, snap-action hooks and/or the like. A latching connection indicates that a directed force has to be applied in order to bring about the latching connection between two components until the components are latched into place. After the components are latched into place, they are secured by the latching means against release of the latching connection.

An optional additional component means, in this patent application, that the component is not assigned any function during the operation. Accordingly, the connector arrangement achieves at least a partial function irrespective of the actuating clip. An electrical function is understood, for example, as meaning that a component conducts electrical current. An electromagnetic function means that a component changes the electromagnetic properties of a component, for example the EMC properties thereof.

Electronic functions relate to the control, for example the switching on and/or switching off or the setting of a certain operating mode of a component.

A connector comprises an interface through which an imaginary interface plane can be placed. The axial longitudinal direction is perpendicular to said interface plane.

Oblique surfaces run monotonously in one direction. Oblique surfaces can have a curvature or can be formed without a curvature.

The present invention is useful for shifting the actuating surfaces of a connector. This is achieved by actuating surfaces of a connector being shifted by means of an actuating clip in the direction of a cable that is connected to the connector.

Accordingly, the actuating clip is placed around the cable, which is connected to the connector, and is connected to a cable-side end of the connector.

If the connector has actuating surfaces, a choice can be made, during the installation or during the connecting of the connector, between the actuating surfaces of the connector and between the actuating surfaces of the actuating clip. If the connector does not have any actuating surfaces, the actuating surfaces of the actuating clip can be reverted to. Consequently, it is not absolutely necessary for the connector to have actuating surfaces.

Actuation of a connector means to plug in, i.e. to mount, the connector, or to release, i.e. to remove same. Accordingly, actuating surfaces are surfaces that can be grasped by a tool or by a human hand in order to actuate the connector.

Advantageous configurations and developments are evident from the further dependent claims and also from the description with reference to the figures of the drawing.

In some embodiments, the surfaces of the actuating clip are designed in terms of ergonomic aspects for manual actuation by the surfaces not having any radially outwardly directed protrusions.

Manual installation with exacting requirements imposed on the ergonomics can thus be ensured. For the ergonomic design of the installation of the connectors, it should be taken into consideration here that a human fitter requires merely a few seconds for plugging in or mounting a connector, and, consequently, mounts a multiplicity of several hundred connectors during one work shift.

Such a high throughput means that a human fitter rapidly obtains wear marks on the fitter's body parts actuating the connector, typically the fingers. A connector or a connector arrangement having further components should thus be designed in such a manner that a fitter does not suffer any pain during the installation of the connector, not even after installing an extremely large number of connectors.

For example, during the installation of a large number of items, outwardly directed protrusions would cause pressure points on the fitter's body parts actuating the connector.

The actuating surface here can have smaller recesses if the actuating surface surrounding the recesses sufficiently supports the actuating body part, i.e. generally the actuating finger, and therefore the recesses in the actuating surfaces do not cause any pressure points.

Furthermore, it is advantageous if the actuating surfaces do not have any harmful materials, i.e., for example, are free from lead and/or free from chromium. It is thus ensured that a human fitter does not have to wear gloves.

It goes without saying that plastic is a suitable material for the actuating clip.

In some embodiments, at least one recess is provided in the interior of the actuating clip in order to ensure spring elasticity of the actuating clip. The recess in the interior of the actuating clip forms a hollow chamber and should not be confused with the recess on the surface of the actuating clip.

Alternatively and/or additionally, the cable receptacle can have one or more interruptions in order to improve the spring elasticity of the actuating clip.

By means of the recess in the interior of the actuating clip, greater spring elasticity of the actuating clip can be ensured compared to an actuating clip that does not have recesses in the interior.

Furthermore, the recesses mean that weight and material can be saved. It can thus be ensured that only a minimal additional weight is incurred by means of the actuating clip and the production costs are kept low.

In some embodiments, the actuating clip can expand in order to be connected to a connector.

The actuating clip can thus be placed easily, i.e. without a particular effort, around the cable of a cable that is connected to the connector. If the actuating clip has recesses, it is advantageous to arrange the recesses in such a manner that they assist the expansion of the actuating clip. For this purpose, it can be provided, for example, to form the recesses symmetrically with respect to an axis about which the actuating clip expands.

It can thus be ensured that an actuating clip can be fastened to a connector without a tool. The expansion can take place, for example, manually by pulling apart the actuating clip or by oblique surfaces on the connector, the surfaces ensuring that the actuating clip expands while the actuating clip is being pushed over corresponding oblique surfaces of the connector.

In some embodiments, the actuating clip has latching means that are configured to interact with latching means of the connector.

Examples of a conceivable latching means include latching lugs on the actuating clip and/or on the connector, said latching lugs interacting with one another by the latching lugs each forming a stop in order to prevent the actuating clip from sliding out with respect to the connector.

The latching means can be designed in particular in such a manner that the latching connection between the actuating clip and the connector cannot be released without a tool.

In some embodiments, the actuating clip forms an optional additional component to a connector, to which in particular no electrical, electromagnetic and/or electronic function is assigned.

Consequently, the actuating clip does not absolutely have to be manufactured from an electrically conductive material, but rather can be manufactured from a cost-effective plastic.

Alternatively, it is conceivable to manufacture the actuating clip from metal, for example in order to obtain a shielding effect against electromagnetic effects or in order to improve the electromagnetic compatibility (EMC) of a connector arrangement.

It goes without saying that a connector arrangement has a connector and an actuating clip, as has been described above, wherein the connector is configured, with a cable in a cable-side region of the connector, to be electrically connected to the cable. The actuating clip is fastened to a cable-side end of the connector and forms an extension in an axial longitudinal direction of the connector.

The present disclosure also teaches a connector arrangement comprising at least one connector, an actuating clip and a cable that is connected to the connector.

It is also advantageous here if the connector has oblique surfaces that cause a continuous expansion of the actuating clip when the actuating clip is guided along the oblique surfaces during its installation on the connector.

This expansion mechanism by means of oblique surfaces of the connector is ergonomically advantageous in comparison to an expansion by a separate tool or even by a fitter's hand.

Alternatively and/or additionally, it is advantageous if the connector has guide means that are used to limit a movement of the actuating clip in at least one spatial direction during its installation on the connector.

For example, the plug connector can have a guide web that guides the actuating clip along the installation direction on the connector and thus prevents the actuating clip from sliding out over the connector region provided for the installation in the direction of an interface-side end of the connector and possibly damaging further components there.

In some embodiments, the connector arrangement comprises actuating surfaces on the connector and actuating surfaces on the actuating clip, wherein the actuating surfaces of the actuating clip are arranged offset radially from the actuating surfaces of the connector.

Accordingly, it can be provided that the connector has actuating surfaces that are arranged laterally on the connector, and the actuating surfaces of the actuating clip are arranged at the top and/or bottom with respect to the connector.

It goes without saying that the features mentioned above and those yet to be explained below can be used not only in the combination respectively indicated, but also in other combinations or by themselves, without departing from the scope of the present invention.

The above configurations and developments can be combined, if practical, arbitrarily with one another. Further possible configurations, developments and implementations of the invention also encompass combinations, not explicitly mentioned, of features of the invention described above or below with regard to the exemplary embodiments. In particular, here a person skilled in the art will also add individual aspects as improvements or supplementations to the respective basic form of the present invention.

INDICATION OF CONTENTS OF THE DRAWING

The present invention is explained in greater detail below on the basis of the exemplary embodiments indicated in the schematic figures of the drawing, in which here:

Figure 1:
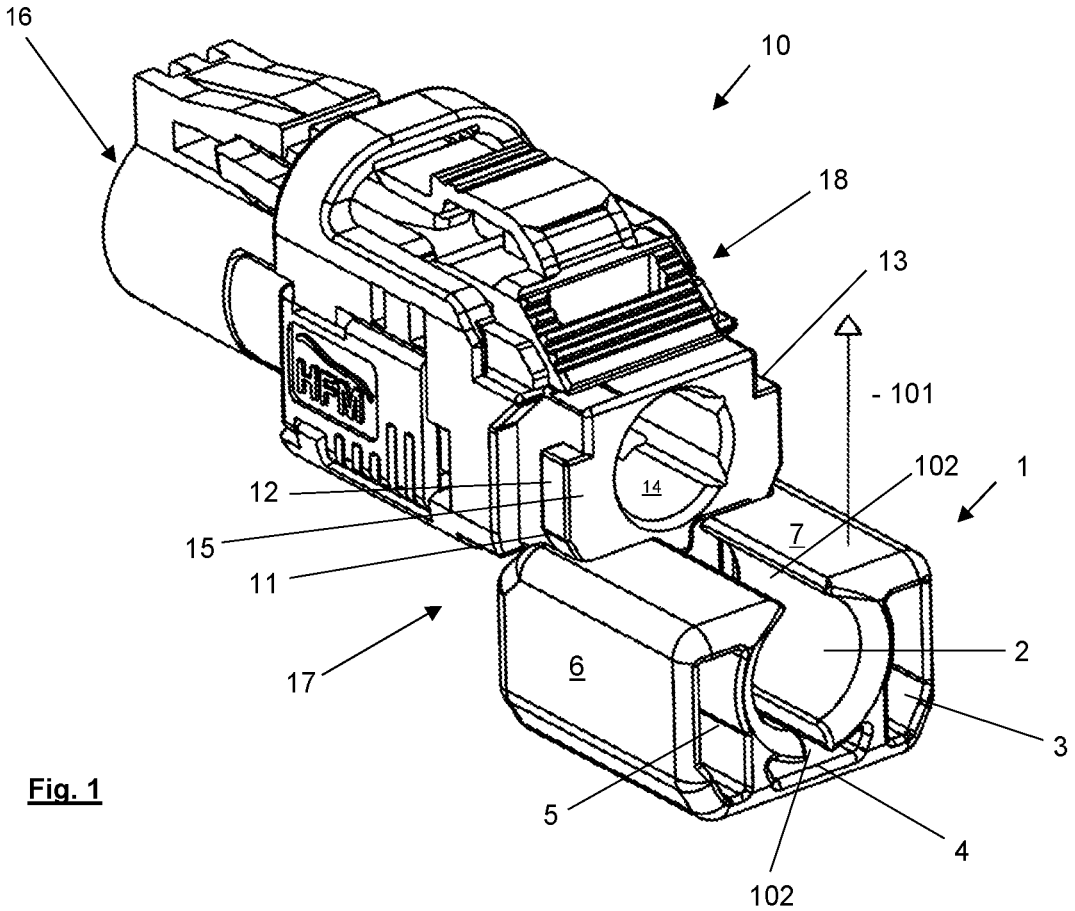
FIG. 1 shows a schematic perspective view of a connector arrangement in accordance with the present disclosure.

The accompanying figures of the drawing are intended to convey a further understanding of the embodiments of the invention. They illustrate embodiments and in association with the description serve to clarify principles and concepts of the invention. Other embodiments and many of the advantages mentioned are evident in view of the drawings.

The elements of the drawings are not necessarily shown in a manner true to scale with respect to one another.

In the figures of the drawing, identical, functionally identical and identically acting elements, features and components—unless explained otherwise—are provided in each case with the same reference signs.

An inter-related and overarching description of the figures is given below.

DESCRIPTION OF EXEMPLARY EMBODIMENTS

FIG. 1 shows a perspective view of a connector arrangement 20 having a connector 10 and having an actuating clip 1. The actuating clip 1 may facilitate handling of the connector 10 and may accordingly be termed a handling clip. The connector 10 comprises a housing 12 that interacts with the actuating clip 1. The connector 10 may be termed an electrical connector.

The connector 10 comprises a cable-side end 15 and an interface-side end 16. A cable receptacle 14 is provided at the cable-side end 15 of the connector 10 in order to receive electrical conductors of a cable and, over the further course of the connector, to make contact with electric contacts of the connector 10.

FIG. 1 shows the connector 10 with the actuating clip 1 directly prior to its installation, i.e. as the actuating clip moves from an disconnected to a joined state relative to the connector 10. Accordingly, a direction of movement along which the actuating clip is to be guided in order to mount the actuating clip 1 on the connector 10 is indicated by a direction arrow 101 in FIG. 1. The actuating clip 1 is accordingly guided from below on a protrusion 15 of the connector 10 and pushed onto the latter with little effort. The protrusion 15 slidingly engages a slot-like structure of actuating clip 1 in the manner of a tongue-and-groove.

During the pushing-on operation, a bevelled edge 9 of the latching lug 8 of the actuating clip 1 moves along the lateral contour of the protrusion 15. The lateral contour of the protrusion 15 of the connector 10 comprises an oblique surface 11, which ensures a continuous expansion of the actuating clip, a vertical surface 12 and a latching lug 13 that interacts with the latching lug 8 of the actuating clip 1 and therefore ensures that the actuating clip 1 is fastened to the connector 10.

The expansion of the actuating clip 1 is facilitated by a plurality of recesses 3, 4 and 5 by said recesses increasing the spring elasticity of the actuating clip. The recesses 3, 4 and 5 are arranged axially symmetrically with respect to the actuating clip, wherein the axis of symmetry runs through the center of the actuating clip 1 in the direction of the arrow 101. Furthermore, the expansion of the actuating clip 1 is facilitated by the edge of the cable receptacle 2 having two opposite interruptions 102.

The actuating clip comprises two times two respectively opposite actuating surfaces, namely two lateral actuating surfaces 6 and upper/lower actuating surfaces 7, wherein the upper actuating surface has a recess on its top surface.

Figure 2:
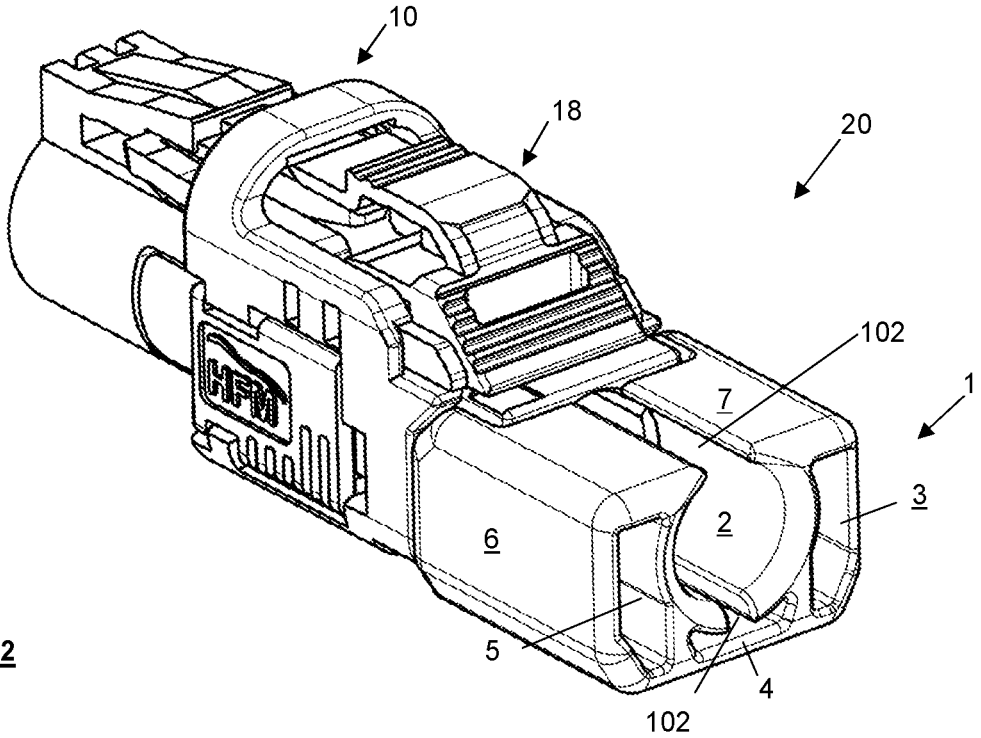
FIG. 2 shows a schematic perspective view of a connector arrangement in accordance with the present disclosure.

FIG. 2 shows a connector arrangement 20 according to FIG. 1, wherein the actuating clip 1 is mounted on the connector 10.

In such a joined state, the actuating clip 1 is secured to the connector 10 in a manner that inhibits separation of the actuating clip 1 from the connector 10 in any direction and that permits transmission of torsional force relative to a longitudinal axis of the connector 10 from the actuating clip 1 to the connector 10.

Figure 3:
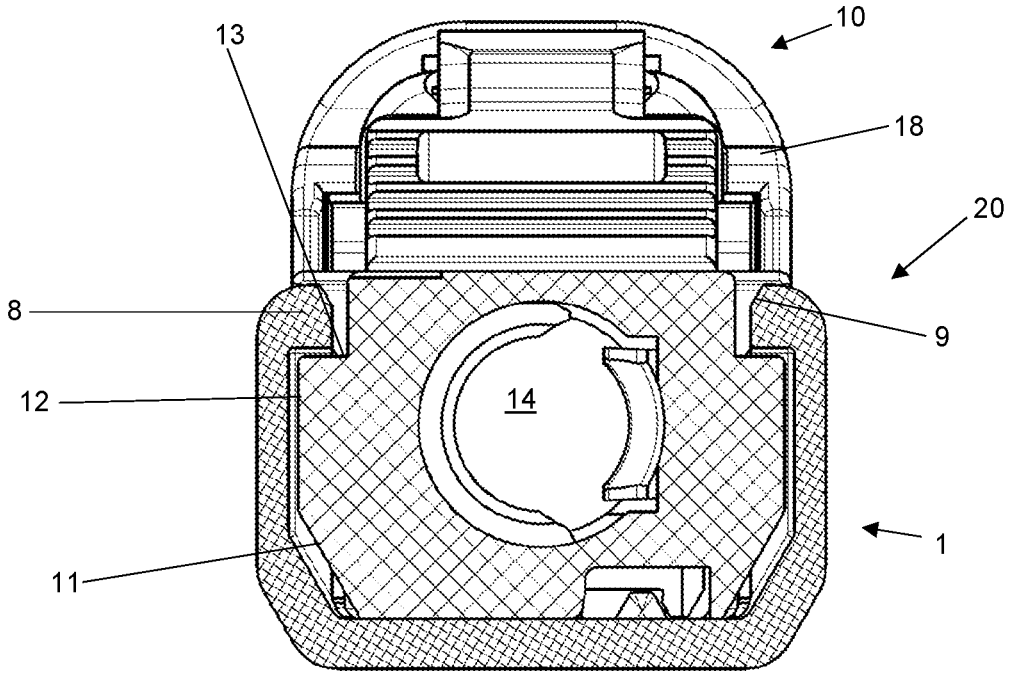
FIG. 3 shows a schematic sectional view of a connector arrangement in accordance with the present disclosure.

FIG. 3 shows a connector arrangement 20 according to FIG. 2, wherein the actuating clip 1 is mounted on the connector 10. FIG. 3 shows a sectional view through a section plane located in the region of the protrusion 15 of the connector 10. The actuating clip 1 in this region has a contour corresponding to the connector 10. Accordingly, the actuating clip 1 forms an offset in the region of the protrusion 15, i.e. in the section plane according to FIG. 3. Accordingly, the inner regions of the actuating clip 1, and also the cable lead-through 2, are set back around the offset. Consequently, the inner regions of the actuating clip 1 that are set back in the region of the protrusion 15 are not illustrated in FIG. 3.

It is apparent in FIG. 3 that the actuating clip 1 is held on the connector by the latching lugs 8 and 13.

Figure 4:
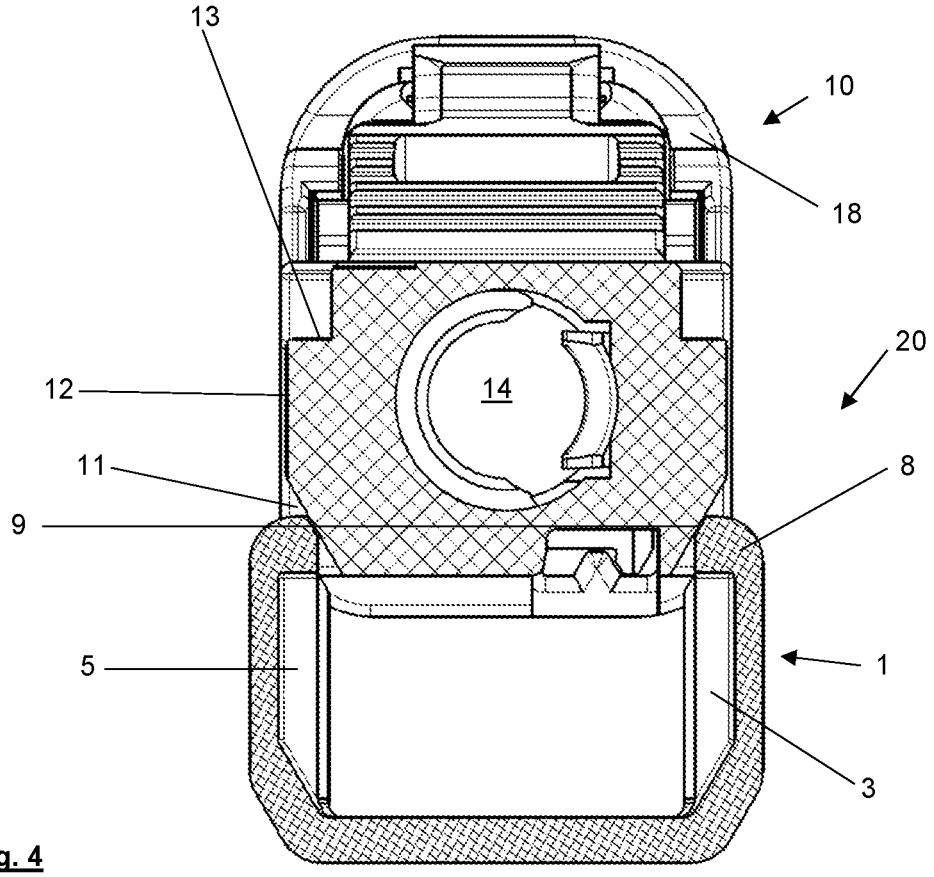
FIG. 4 shows a schematic sectional view of a connector arrangement in accordance with the present disclosure.

FIG. 4 shows a schematic sectional view of a connector arrangement 20 through the section plane according to FIG. 3, wherein the actuating clip is not yet fastened to the connector 10, but rather is in a preassembled state.

FIG. 4 illustrates the expansion operation of the actuating clip 1 by the oblique edge 9 of the actuating clip 1 sliding up on the oblique surface 11 of the connector. The oblique edge 9 ensures an improved guiding of the movement of the actuating clip 1.

The present disclosure may be summarized as disclosing, inter alia, the following Embodiments.

Embodiment 1

Actuating clip (1) for a connector (10), having a cable receptacle (2) for receiving at least one cable;

connecting means in order to connect the actuating clip to the connector in such a manner that the actuating clip adjoins the connector at a cable-side end of the connector;

surfaces for actuating the connector (10), which are configured to ensure guiding of the connector (10) when the latter is connected to an actuating clip by the surfaces of the actuating clip (1) being able to be gripped by a human hand and/or by a gripping tool, wherein the surfaces of the actuating clip (1) are specifically designed to be gripped by a hand and/or by a gripping tool.

Embodiment 2

Actuating clip (1) for a connector (10) according to Embodiment 1, wherein the surfaces of the actuating clip (1) are designed in terms of ergonomic aspects for manual actuation by the surfaces not having any radially outwardly directed protrusions.

Embodiment 3

Actuating clip (1) for a connector (10) according to either of the preceding Embodiments, wherein at least one recess is provided in the interior of the actuating clip (1), and/or the cable receptacle has at least one, in particular two interruptions (102) in order to ensure spring elasticity of the actuating clip (1).

Embodiment 4

Actuating clip (1) for a connector (10) according to one of the preceding Embodiments, wherein the actuating clip (1) is expandable in order to be connected to a connector (10).

Embodiment 5

Actuating clip (1) for a connector (10) according to one of the preceding Embodiments, wherein the actuating clip (1) has latching means that are configured to interact with latching means of the connector (10).

Embodiment 6

Actuating clip (1) for a connector (10) according to one of the preceding Embodiments, wherein the actuating clip (1) forms an optional additional component to a connector (10), to which in particular no electrical, electromagnetic and/or electronic function is assigned.

Embodiment 7

Connector arrangement having a connector (10) and having an actuating clip (1) according to one of the preceding Embodiments, which, with a cable in a cable-side region of the connector (10), is electrically connectable to contacts of the connector (10), and the actuating clip (1) is fastened to a cable-side end of the connector (10) and forms an extension of the connector (10) in an axial longitudinal direction.

Embodiment 8

Connector arrangement according to Embodiment 7, wherein the connector (10) has oblique surfaces that cause a continuous expansion of the actuating clip (1) when the actuating clip (1) is guided along the oblique surfaces during its installation on the connector (10).

Embodiment 9

Connector arrangement according to Embodiment 7 or Embodiment 8, wherein the connector (10) has guide means that are used to limit a movement of the actuating clip (1) in at least one spatial direction during its installation on the connector (10).

Embodiment 10

Connector arrangement according to one of the preceding Embodiments 7-9, wherein the connector has actuating surfaces, wherein the actuating surfaces of the actuating clip are arranged radially offset from the actuating surfaces of the connector.

LIST OF REFERENCE SYMBOLS

1 Actuating clip
2 Cable receptacle
3 Recess
4 Recess
5 Recess
6 Actuating surface
7 Actuating surface
8 Latching lug
9 Edge
10 Connector
11 Oblique surface
12 Vertical surface
13 Latching lug
14 Receptacle
15 Protrusion
16 Interface-side end
17 Cable-side end
18 Connector housing
20 Connector arrangement
101 Arrow
102 Interruption

The invention claimed is:

1. A connector assembly, comprising:
an electrical connector, and
a handling clip, wherein
said electrical connector comprises an interface portion and a cable-receiving portion,
said cable-receiving portion comprises a first cable receptacle,
said handling clip comprises a second cable receptacle,
said second cable receptacle defines a generally circular cylindrical passage, and
said cable-receiving portion and said handling clip are shaped such that a motion of
said handling clip relative to said cable-receiving portion from a separated state toward a joined state incurs a dilation of said second cable receptacle and said generally circular cylindrical passage.

2. The connector assembly of claim 1, wherein:
said handling clip comprises at least two opposing gripping surfaces,
each of said at least two opposing gripping surfaces is sized for manipulation of said handling clip using individual fingers,
in said joined state, said at least two opposing gripping surfaces are fully exposed and accessible for manual manipulation, and
in said joined state, manual manipulation of said handling clip via said at least two opposing gripping surfaces effects a corresponding motion of said electrical connector.

3. The connector assembly of claim 2, wherein:
said handling clip comprises an outer wall and an inner wall distinct from said outer wall,
said outer wall constitutes at least a portion of said at least two opposing gripping surfaces,
said inner wall constitutes at least a portion of said second cable receptacle, said handling clip comprises a first tubular structure and a second tubular structure,
a first portion of said outer wall constitutes a portion of said first tubular structure,
a second portion of said outer wall constitutes a portion of said second tubular structure,
a first portion of said inner wall constitutes a portion of said first tubular structure, and
a second portion of said inner wall constitutes a portion of said second tubular structure.

4. The connector assembly of claim 3, wherein:

an imaginary straight line through said handling clip intersects, in order, said first portion of said outer wall, a hollow region of said first tubular structure, said first portion of said inner wall, said generally circular cylindrical passage, said second portion of said inner wall, a hollow region of said second tubular structure, and said second portion of said outer wall.

5. The connector assembly of claim 1, wherein:

said first cable receptacle has a generally tubular shape, and in said joined state, said generally circular cylindrical passage is adjacent to and substantially aligns with said first cable receptacle.

6. The connector assembly of claim 1, wherein:

said first cable receptacle is structured to receive a first portion of a cable, and said second cable receptacle is structured to receive, in said joined state, a second portion of said cable adjacent said first portion.

7. The connector assembly of claim 1, wherein:

said interface portion is structured to mechanically engage a counterpart connector and comprises a plurality of contacts structured to electrically contact said counterpart connector.

8. The connector assembly of claim 1, wherein:

said handling clip comprises a plurality of surfaces that collectively define an entire outer circumference of said handling clip in a circumferential direction around said second cable receptacle, and each of said surfaces is devoid of skin-damaging protrusions.

9. The connector assembly of claim 1, wherein:

said second cable receptacle comprises at least two slits subdivide an interior, generally circular cylindrical wall of said second cable receptacle in a manner that reduces a force necessary to effect said dilation of said second cable receptacle.

10. The connector assembly of claim 9, wherein:

said at least two slits subdivide said interior, generally circular cylindrical wall into two substantially symmetrical structures.

11. The connector assembly of claim 1, wherein:

said handling clip is devoid of electrical, electromagnetic and electronic functionality.

12. The connector assembly of claim 1, wherein:

said electrical connector comprises an engagement structure at a longitudinally terminal end of said electrical connector, and in said joined state, said engagement structure substantially fills a generally U-shaped, interior cross-section of said handling clip.

13. The connector assembly of claim 1, wherein:

said electrical connector comprises a first engagement structure at a longitudinally terminal end of said electrical connector, said handling clip comprises a second engagement structure at a longitudinally terminal end of said handling clip, said first engagement structure is structured to slidingly receive said second engagement structure in a tongue-and-groove-like arrangement, and said first engagement structure and said second engagement structure are structured to snappingly engage.

14. The connector assembly of claim 1, wherein:

in said joined state, said handling clip is secured to said electrical connector in a manner that inhibits separation of said handling clip from said electrical connector in any direction and that permits transmission of torsional force relative to a longitudinal axis of said electrical connector from said handling clip to said electrical connector.

15. The connector assembly of claim 1, wherein:

in said joined state, said first cable receptacle is adjacent to and aligned with said second cable receptacle, and in said joined state, an overall length of said connector assembly is larger than an overall length of said first cable receptacle.

16. A connector assembly, comprising: an electrical connector, and a handling clip, wherein said electrical connector comprises an interface portion and a cable-receiving portion, said cable-receiving portion comprises a first cable receptacle, said handling clip comprises a second cable receptacle, said cable-receiving portion and said handling clip are shaped such that a motion of said handling clip relative to said cable-receiving portion from a separated state toward a joined state incurs a dilation of said second cable receptacle relative to a natural condition of said second cable receptacle, and said second cable receptacle defines a generally circular cylindrical passage.

17. A connector assembly, comprising: an electrical connector, and a handling clip, wherein said electrical connector comprises an interface portion and a cable-receiving portion, said cable-receiving portion comprises a first cable receptacle, said handling clip comprises a second cable receptacle, said cable-receiving portion and said handling clip are shaped such that a motion of said handling clip relative to said cable-receiving portion from a separated state toward a joined state forces an outward-facing structure of said cable-receiving portion into an opening in said handling clip and, as a result of a dimension of said outward-facing structure being larger than a dimension of said opening, incurs a dilation of said second cable receptacle, and said second cable receptacle defines a generally circular cylindrical passage.

18. The connector assembly of claim 17, wherein: said second cable receptacle comprises at least two slits that subdivide an interior, generally circular cylindrical wall of said second cable receptacle in a manner that reduces a force necessary to effect said dilation of said second cable receptacle.

19. A connector assembly, comprising: an electrical connector, and a handling clip, wherein said electrical connector comprises an interface portion and a cable-receiving portion, said cable-receiving portion comprises a first cable receptacle, said handling clip comprises a second cable receptacle, said cable-receiving portion and said handling clip are shaped such that a motion of said handling clip relative to said cable-receiving portion from a separated state toward a joined state incurs a dilation of said second cable receptacle, and said second cable receptacle comprises at least two slits that subdivide an interior, generally circular cylindrical wall of said second cable receptacle in a manner that reduces a force necessary to effect said dilation of said second cable receptacle.

20. The connector assembly of claim 19, wherein:

said at least two slits subdivide said interior, generally circular cylindrical wall into two substantially symmetrical structures.

21. The connector assembly of claim 19, wherein:

in said joined state, said first cable receptacle is adjacent to and aligned with said second cable receptacle, and in said joined state, an overall length of said connector assembly is larger than an overall length of said first cable receptacle.

* * * * *